US006390328B1

(12) United States Patent
Obermeier et al.

(10) Patent No.: US 6,390,328 B1
(45) Date of Patent: May 21, 2002

(54) MODULAR ARTICLE DISPENSING UNIT FOR AN AUTOMATIC VENDING MACHINE

(75) Inventors: Juergen Obermeier, Huellhorst; Horst Schmidt, Bad Oeynhausen; Bernhard Rath, Enger, all of (DE)

(73) Assignee: Deutsche Wurlitzer GmbH, Stemwede-Leven (DE)

( * ) Notice: Subject to any disclaimer, the term of this patent is extended or adjusted under 35 U.S.C. 154(b) by 0 days.

(21) Appl. No.: 09/667,911

(22) Filed: Sep. 22, 2000

(30) Foreign Application Priority Data

Sep. 25, 1999 (DE) ..... 199 46 030

(51) Int. Cl.[7] ..... B65H 3/60
(52) U.S. Cl. ..... 221/203; 221/266
(58) Field of Search ..... 221/92, 131, 123, 221/203, 200, 312 R, 266, 269, 199; 194/350

(56) References Cited

U.S. PATENT DOCUMENTS 2,877,928 A 3/1959 Patzer
5,092,817 A * 3/1992 Abe ..... 221/203
5,351,856 A 10/1994 Laidlaw

FOREIGN PATENT DOCUMENTS

DE 90 02 363.3 U1 6/1990
JP 7-57146 A 3/1995

* cited by examiner

*Primary Examiner*—Kenneth W. Noland
(74) *Attorney, Agent, or Firm*—Hahn Loeser + Parks LLP; Stephen L. Grant

(57) ABSTRACT

A modular article dispensing unit for an automatic vending machine includes an article compartment for accommodating articles with a rotatably mounted rotary body at the dispensing opening of the article compartment for the removal and discharge of individual articles from the article compartment. The rotary body has at least one recess which in a removal position is filled with an article from the article compartment and delivers the article after a predetermined rotary movement in a dispensing position. Arranged in the interior of the article compartment is at least one motion member which is set in motion prior to and/or during each rotary movement of the rotary body.

18 Claims, 3 Drawing Sheets

MODULAR ARTICLE DISPENSING UNIT FOR AN AUTOMATIC VENDING MACHINE

The invention concerns a modular article dispensing unit for an automatic vending machine, with an article compartment for accommodating articles, with a rotatably mounted rotary body at the dispensing opening of the article compartment for removing and dispensing individual articles from the article compartment, wherein the rotary body has at least one recess, in a removal position removes an article from the article compartment and after a predetermined rotary movement in a dispensing position delivers the article.

BACKGROUND OF THE ART

An article dispensing unit of that kind is known for example from DE 21 39 955 A1, in which articles are fed separately from an article compartment to a rotary body and are delivered after a predetermined rotary movement into a dispensing position. Disposed in front of the rotary body is a separating section which leads out of the article compartment and which feeds the articles separately and in isolation successively to the rotary body at the end of the separating section. The preceding operation of separating the articles into separate items means that the article dispensing unit is of a relatively large structural volume. Direct removal of the article from the article compartment is not possible.

DE 154 711 also discloses a modular article dispensing unit in which articles are removed from the article compartment directly by the rotary body, wherein after a predetermined rotary movement a part of the article is pushed sideways out of the article wrapping or article packaging and the article wrapping is then discharged into a collecting container, after a further rotary movement of the rotary body. Arranged in the interior of the article component above the rotary body is a fixed deflection projection which is intended to ensure that the articles pass separately to the periphery of the rotary body. For that purpose, the deflection projection is intended to prevent a plurality of mutually superposed articles blocking the recess in the rotary body and impeding entry of individual articles into the recesses in the rotary body. It has been found however that in the region of the fixed deflection projection the articles form so-called bridges and therefore become wedged tight against each other and thereby prevent the flow of articles to the rotary body.

SUMMARY OF THE INVENTION

Therefore the object of the invention is to develop a modular dispensing unit of the kind set forth in the opening part of this specification, in such a way that the formation of bridges of articles upstream of the rotary body is reliably prevented, and therefore the feed flow of the articles to the recess or recesses in the rotary body is always reliably guaranteed.

That object is attained by a modular article dispensing unit for an automatic vending machine, with an article compartment for accommodating articles, with a rotatably mounted rotary body at the dispensing opening of the article compartment for removing and dispensing individual articles from the article compartment, wherein the rotary body has at least one recess, in a removal position removes an article from the article compartment and after a predetermined rotary movement in a dispensing position delivers the article characterized by at least one motion member in the interior of the article compartment, which is set in motion prior to and/or during each rotary movement of the rotary body.

The advantages of the invention are in particular that the motion member in the interior of the article compartment is set in motion prior to and/or during each rotary movement of the rotary body, whereby the articles are also moved in the region of the motion member. That makes it possible to prevent the articles from becoming wedged or jammed, that is to say it prevents them from forming bridges, while the action of the motion member on the articles is particularly advantageous in the region in which the articles are intended individually to pass into the recess in the rotary body.

In a particularly preferred feature the motion member or members is or are driven in operative relationship with the rotary body and is or are set in motion directly or indirectly by the rotary body. Preferably the motion member is supported pivotably about an axis which extends parallel to the axis of the rotary body. The motion member is preferably arranged in the interior of the article compartment in such a way that it is in direct mechanical contact with the rotary body and upon rotation of the rotary body performs a pivotal movement which has the result that articles disposed above the motion member are lifted, thereby reliably eliminating the onset of article bridge formation.

In accordance with a preferred embodiment of the invention the motion member has an upper engagement portion which is directed towards the articles in the article compartment and a lower engagement portion which upon rotation of the rotary member during predetermined time intervals comes into engagement with the rotary member. In that case the motion member is for example in the form of a segment of a wedge or circular surface, which is mounted pivotably in the region of its tip. Alternatively, the motion member may be in the form of a doublearmed angle lever whose upper arm forms the upper engagement portion and whose lower arm forms the lower engagement portion which is deflected by the rotary body, wherein the lower arm and the upper arm extend at an angle which is preferably <180°, preferably even less than 90°.

It is possible to provide on the rotary body control projections or cams which in the rotary movement of the rotary body come into engagement with the motion member and deflect the motion member prior to or during each rotary movement of the rotary body and in that way lift the articles disposed thereabove in order to prevent the articles from forming bridges.

In accordance with a preferred embodiment of the invention there is provided a first electrical drive device for driving the rotary body. The first electrical drive device can also be used for driving the motion member which then for example is displaced with a pivotal movement by way of a transmission and an additional control means during suitable periods of time of the overall rotary movement of the rotary body. Alternatively, it is also possible to provide a second electrical drive which only drives the motion members synchronously with the rotary body.

Preferably a plurality of recesses are provided at the periphery of the rotary body so that to remove and dispense an article only a predetermined rotary angle which is less than or equal to 180° has to be covered. The rotary body is for example in the form of a rotationally symmetrical cylinder in which the recesses are grooves which extend parallel to the axis of rotation and which extend over the entire width of the rotary body. The recesses are preferably matched to the shape of the articles which are to be dispensed in the article dispensing unit. If for example the articles are in the form of drinks cans, then the recesses are of a circular cross-section which is suitably open at the periphery of the rotary body.

The article compartment has two spaced parallel side walls, a rear wall, a front wall and a bottom. The bottom preferably extends inclinedly downwardly and forwardly and the dispensing opening of the article compartment is preferably in the corner region between the bottom and the front wall.

Preferably the rotary body is arranged in the dispensing opening in such a position that the articles run or roll down directly into a recess under their own weight on the inclined bottom of the article compartment, when the rotary body is at a stop. In a preferred embodiment of the invention, the motion member can then also be moved mechanically in synchronous relationship with the movement which then occurs, of the rotary body.

The rotary body forms between the recesses so-called lobes or vanes which are spaced uniformly in the peripheral direction and directed radially outwardly and which with their free end represent part of the cylindrical peripheral contour of the rotary body. When the rotary body rotates in the clockwise direction, a respective vane passes from below into the interior of the article compartment and a respective vane passes forwardly out of the article compartment. For example there are three recesses in the rotary body, which are each separated from each other by a respective vane. For the purposes of separating and discharging the article, the rotary body is rotated stepwise through 180° in each case. During the rotary movement of the rotary body the next article in the article compartment rolls into the next recess and is picked up by the rotary body and entrained into a viewing position of being readily visible from the front. In a second rotary movement through 120° the vane further entrains that article and then discharges that article into a dispensing compartment in the dispensing position.

BRIEF DESCRIPTION OF THE DRAWING

Advantageous developments of the invention are characterized by the features of the appendant claims. An embodiment of the invention is described in greater detail here in after with reference to the drawing in which:

DETAILED DESCRIPTION OF THE INVENTION

Figure 1:
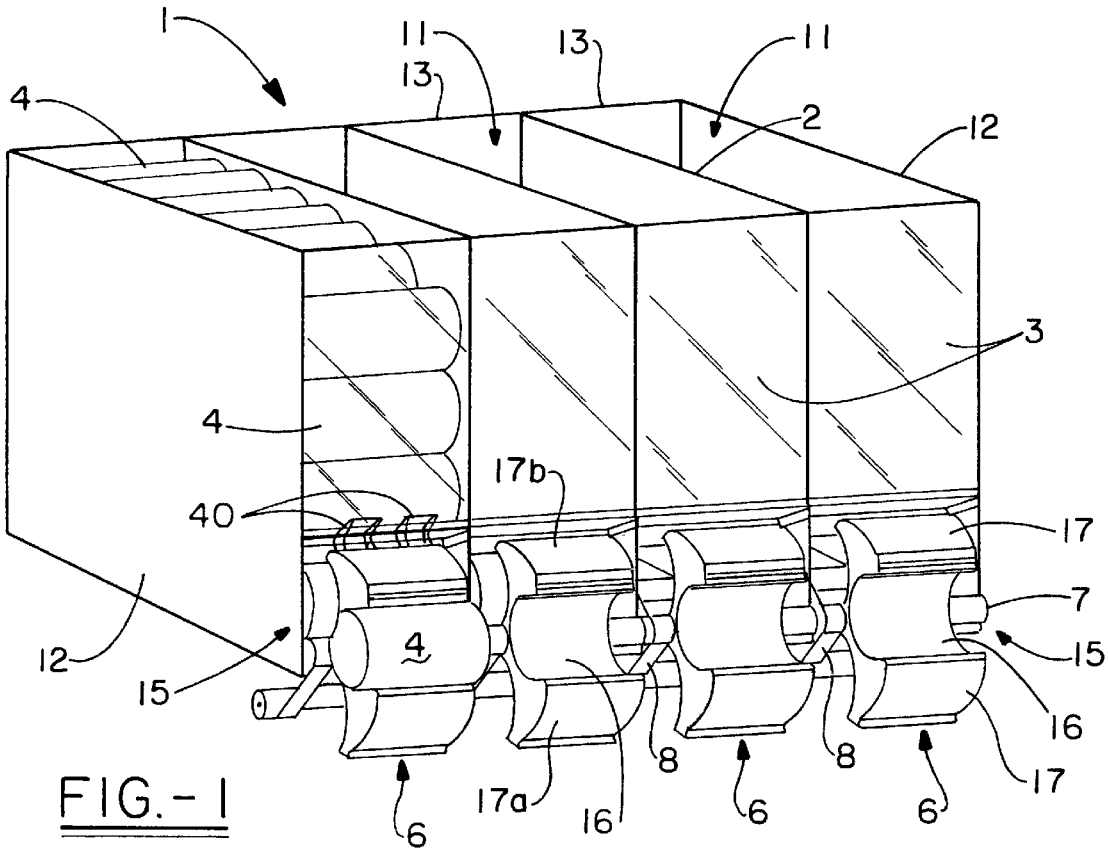
FIG. 1 is a perspective view of an article dispensing unit for drinks cans.
Figure 2:
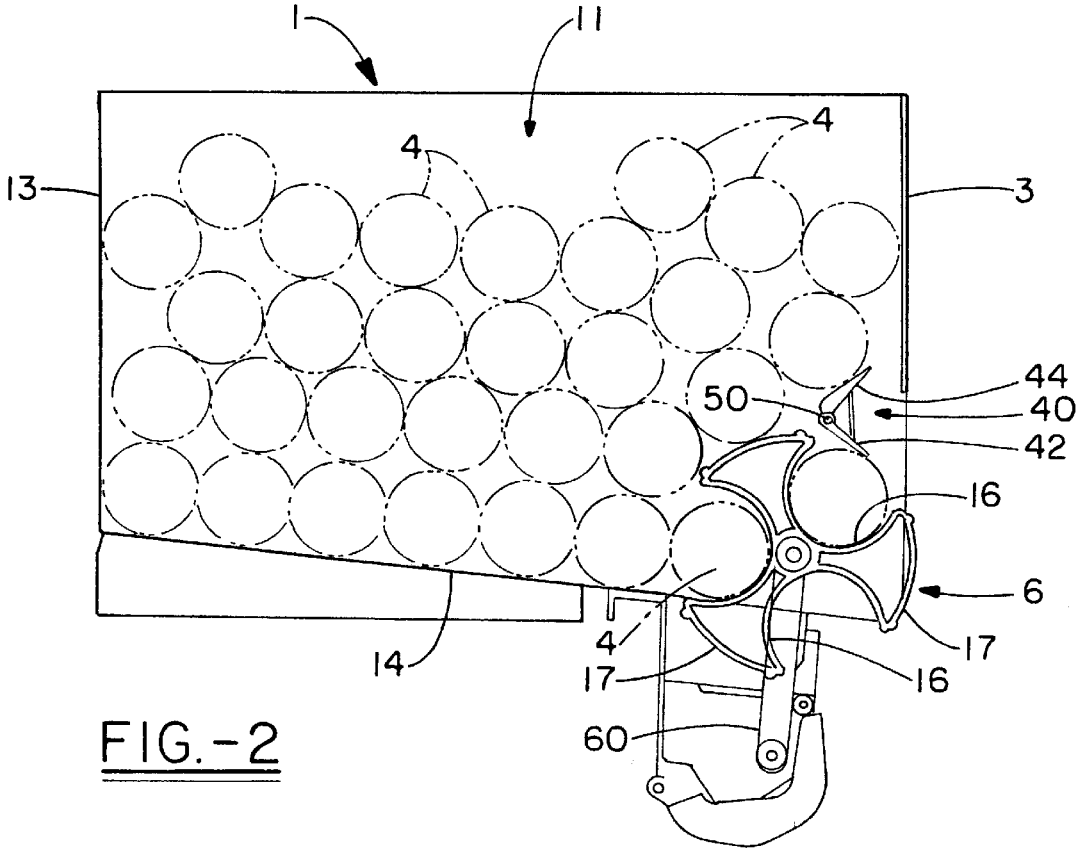
FIG. 2 is a view in section of the article dispensing unit shown in FIG. 1.

The article dispensing unit shown in FIGS. 1 and 2 has an article compartment 1 which is provided for accommodating drinks cans 4 or beverage containers. The width of the article compartment 1 approximately corresponds to the length of the drinks can 4. The drinks cans 4 can be disposed in the article compartment 1 horizontally with their longitudinal axis at a right angle to the side walls 12 of the article compartment 1 or the intermediate walls 2. The depth of the article compartment 1 between the front wall 3 and the rear wall 13 is such that a plurality of drinks cans 4 can be disposed one behind the other. The height of the article compartment 1 is such that a plurality of layers of drinks cans 4 can be arranged in mutually superposed relationship. In that respect precise positioning of each drinks can 4 in the article compartment 1 is not an important consideration.

The front wall 3 of the article compartment 1 is transparent so that it is possible to see into the article compartment 1 from the front. A dispensing opening 15 is provided in each shaft section 11 of the article compartment 1 in the portion where the front wall 3 or front plate and the bottom 14 of the article compartment 1 come together. The bottom 14 of the article compartment 1 is arranged in the form of an inclined plane in the article compartment 1 in such a way that the inclined plane slopes with a fall in the direction of the dispensing opening 15 or the front wall 3 of the article compartment 1.

A rotary body 6 of a substantially cylindrical shape is supported horizontally rotatably about an axis 7 in the dispensing opening 15, as a separating and dispensing means. In the illustrated embodiment each rotary body 6 of a shaft section 11 has in the peripheral direction three recesses 16 which are spaced uniformly from each other, more specifically through an angle of 1200. The recesses 16 are in the form of grooves which extend parallel to the axis 7 so that a drinks can 4 can be supported therein, with its longitudinal axis parallel to the axis of rotation 7 of the rotary body 6. The shape of the recesses 16 corresponds to the shape of the article. Provided between the recesses 16 are the lobes or vanes 17 of the rotary body 6, the free ends of which form a part of the cylindrical peripheral contour of the rotary body 6.

The rotary body 6 associated with a respective shaft section 11 of the article compartment 1 is provided with a drive device 60 which includes a geared motor 62 which for example by way of a toothed belt drives the rotary body 6 stepwise in the clockwise direction so that the vanes 17 pass in the clockwise direction from below into the article compartment 1 through the dispensing opening 15, receive an article and together with the article issue from the article compartment 1 through the dispensing opening 15 in the front wall 3.

The drive device is controlled in such a way that a peripheral portion of the rotary body 6 successively passes through a removal position, a holding position and a dispensing position when the rotary body 6 is rotated, as is described in greater detail hereinafter. Alternatively a plurality of holding positions are possible, between the removal position and the dispensing position.

Figure 3:
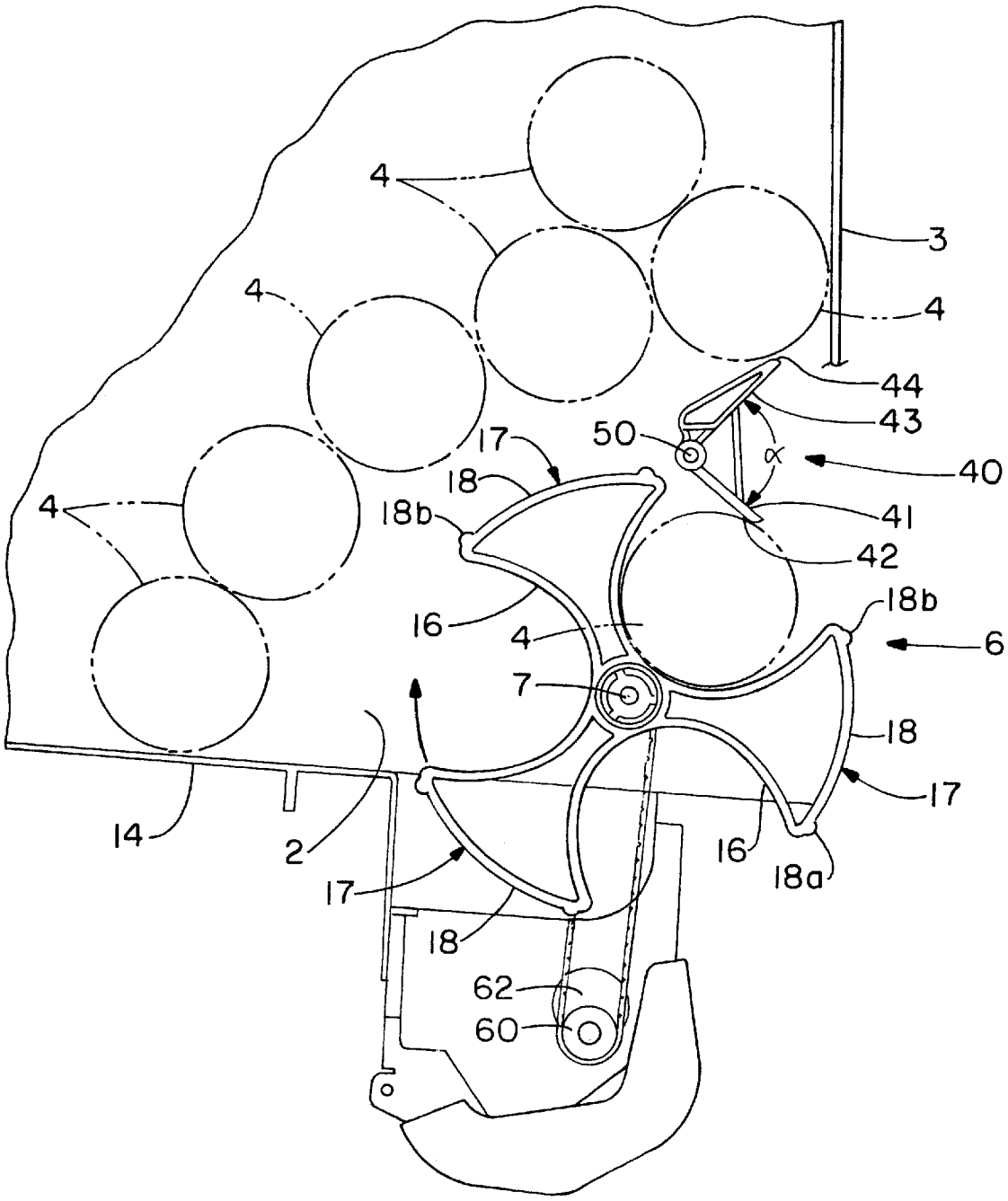
FIG. 3 is a side view on an enlarged scale of the dispensing mechanism of the article dispensing unit shown in FIG. 1 or FIG. 2 upon removal and dispensing of an article, wherein the articles in a bridge configuration block access to the dispensing mechanism, and is
Figure 4:
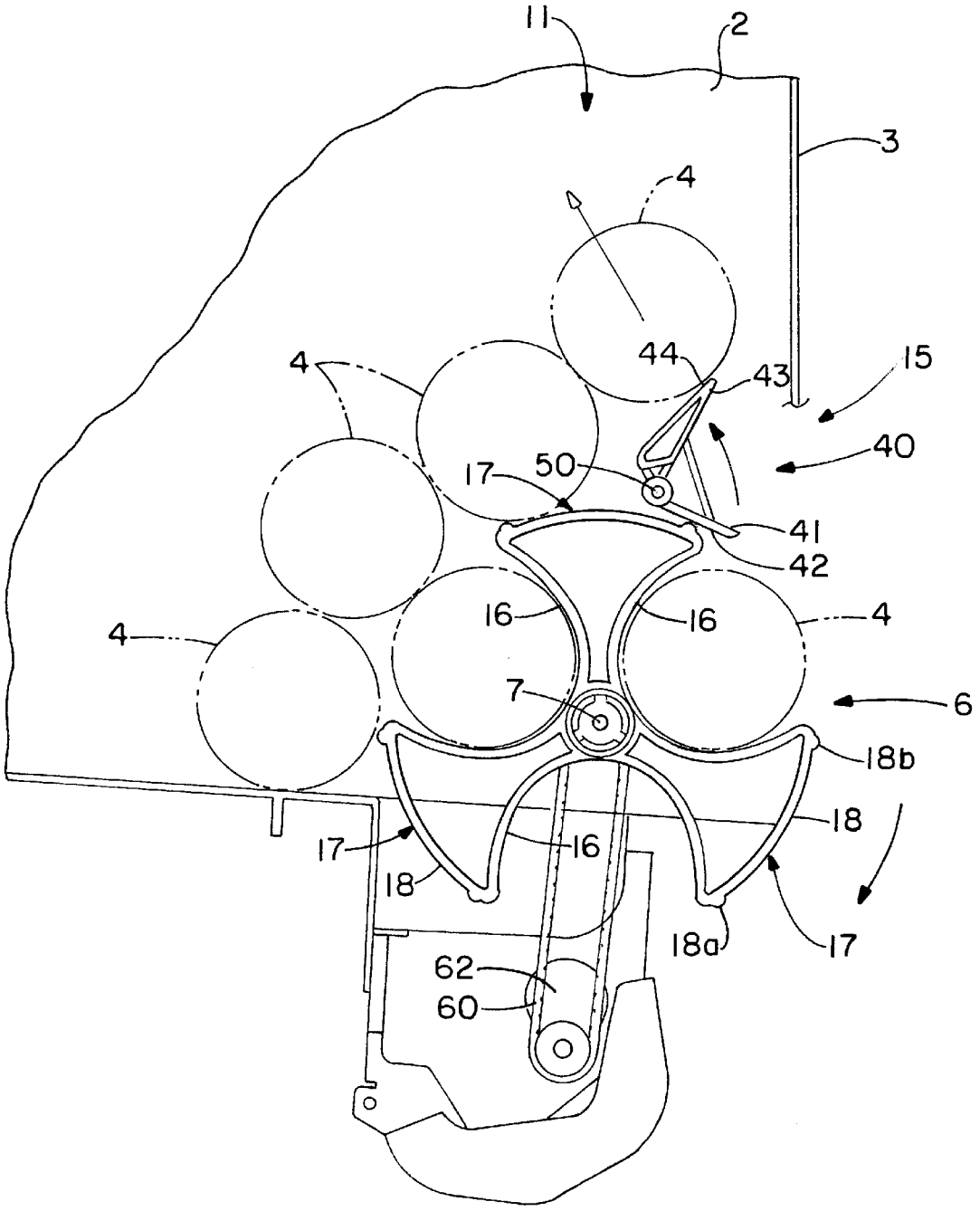
FIG. 4 is a view corresponding to FIG. 3, illustrating elimination of the article bridge configuration.

FIGS. 3 and 4 show the dispensing mechanism of the article dispensing unit of FIGS. 1 and 2 on an enlarged scale. In this respect a major consideration is that, as shown in FIG. 3, the articles 4 have a tendency to form in front of the dispensing mechanism a so-called bridge in which the articles 4 are jammed or wedged tight in the region of the dispensing mechanism in such a fashion that the articles 4 which are adjacent to the rotary body 6 cannot move any further, under their own weight. The consequence of this is that the articles 4 no longer pass into the recesses 16 in the rotary member 6 so that, in a regular dispensing procedure—that is to say in spite of correct payment being made for the article—no article can pass into the rotary body and thus be dispensed. The stack of articles disposed above the bridge configuration additionally stabilizes the bridge configuration and thus additionally increases the wedging and jamming effect.

To avoid the bridge configuration which is formed by the articles in the article shaft section, provided in the interior 2 of the article compartment 1, more specifically in the illustrated embodiment at the inside at the front wall 3 of the article compartment 1, is a motion member 40. In the illustrated embodiment the motion member 40 is in the form of an angle lever and is supported pivotably about an axis 50 which extends parallel to the axis 7 of the rotary body 6 at a predetermined spacing over the width of the article compartment 1 or over the width of a plurality of article compartments. In this arrangement, the spacing of the axis 15 from the axis of rotation 7 of the rotary body 6 is such that, upon rotation of the rotary body 6, the motion member 40 passes into direct mechanical contact with the rotary body 6, more specifically with the free ends of the vanes, and is forced to perform a pivotal movement upon contact with the rotary body 6 by the vanes 17.

In the illustrated embodiment, the motion member 40 is in the form of a two-armed angle lever whose lower arm 41 has a lower engagement portion 42 and whose upper arm 43 has an upper engagement portion 44. Upon a rotary movement of the rotary body 6 the lower engagement portion 42 comes into mechanical engagement contact with the external contour 18 of the vanes 17 and is pivoted thereby so that the upper engagement portion 44 presses against the periphery of an article 4 and urges said article 4 upwardly in order in that way to remove the jamming effect of the bridge configuration. In that way the articles—in the illustrated embodiment being drinks cans—can fall towards the rotary body under their own weight, and one of the articles passes into the recess 16 of the rotary body, which is still free, and in the next dispensing operation that article in question is then dispensed.

The two arms 41, 43 of the motion member 40 which is in the form of an angle lifting member form relative to each other an angle a of 180°, preferably between 60° and 120°. The two arms 41, 43 of the angle lever are directed with their free ends towards the front wall 3 and the dispensing opening 15 respectively of the article compartment. In the illustrated embodiment arranged at the periphery 18 of the vanes 17 of the rotary body 6 are control projections or cams 18*a,* 18*b* which are directed radially outwardly and which impart a respective additional motion pulse to the motion member 40 when the lower arm 41 slides over the control cams 18*a,* 18*b*. The motion member can also be in the form of a segment of a circular disk which is mounted pivotably at its tip at the axis 50, but alternatively it is also possible to envisage various other peripheral configurations for the motion member 40.

Alternatively, it is also possible for the motion member 40—or for each article compartment 1 a plurality of motion members 40 which are arranged in parallel mutually juxtaposed relationship—to be driven by way of a drive which is derived from the first drive 60, or by way of its or their own second electrical drive (not shown). The important consideration is that each motion member 40 is set in motion prior to and/or during each dispensing procedure, that is to say during each motion step of the rotary body 6, so that the bridge configuration of the articles is reliably destroyed prior to each removal/dispensing procedure, so that the removal of an article is guaranteed in each dispensing operation.

What is claimed is:

1. A unit for dispensing modular articles from an automatic vending machine having a compartment for accommodating the articles in an interior thereof and a rotary body rotatably mounted at a dispensing opening of the compartment for removing and dispensing articles individually therefrom, the rotary body having at least one recess in a periphery thereof that, in a removal position removes one said article from the compartment and after a predetermined rotary movement to a dispensing position delivers the article, characterized by at least one motion member in the interior of the compartment, which is set in motion prior to and/or during each rotary movement of the rotary body.

2. The modular article dispensing unit of claim 1 characterized in that each said at least one motion member is operatively connected to the rotary body and can be set in motion by the rotary body.

3. The modular article dispensing unit of claim 1 wherein each said at least one motion member is supported pivotably about an axis which extends parallel to an axis of the rotary body such that upon rotation of the rotary body, each said motion member comes into direct mechanical contact with the rotary member and in so doing triggers a pivotal movement thereof.

4. The modular article dispensing unit as set forth in claim 3 characterized in that an upper engagement portion of each said at least one motion member bears against the articles in the compartment and a lower engagement portion thereof engages the rotary body.

5. The modular article dispensing unit as set forth in claim 4 characterized in that the lower and upper engagement portions are at an increasing spacing from each other with increasing spacing from the pivot axis.

6. The modular article dispensing unit as set forth in claim 5 characterized in that each said at least one motion member is in the form of a two armed angle lever, an upper arm of which forms the upper engagement portion and a lower arm of which carries the lower engagement portion, such that the lower arm and the upper arm project radially from the pivot axis at a predetermined angle of less than 180 degrees.

7. The modular article dispensing unit of claim 6 wherein control cams are provided on the rotary body which come into engagement with and deflect at least one said motion member upon rotation of the rotary body.

8. The modular article dispensing unit of claim 7 wherein the rotary body has at least two said recesses at the periphery thereof, each said recess for removing and delivering one said article from the compartment.

9. The modular article dispensing unit of claim 8 wherein each said recess is a groove extending parallel to the axis of rotation.

10. The modular article dispensing unit of claim 9 wherein the compartment has two spaced parallel side walls, a rear wall, a front wall and a bottom, such that the dispensing opening is arranged in a corner region defined by the bottom and the front wall.

11. The modular article dispensing unit of claim 18 wherein the motion member operatively engages the free ends of the lobes and is moved thereby and comes out of contact with the rotary body in the peripheral portions forming the recesses.

12. The modular article dispensing unit of claim 11 wherein the recesses are matched to the shape of the articles.

13. The modular article dispensing unit of claim 10 wherein the compartment bottom inclines obliquely downwardly towards the dispensing opening.

14. The modular article dispensing unit of claim 1 further comprising a first device for driving the rotary body stepwise through predetermined stepping angles.

15. The modular article dispensing unit of claim 14 wherein the first drive device also drives each said at least one motion member.

16. The modular article dispensing unit of claim 15 further comprising a second device for driving each said at least one motion member.

17. The modular article dispensing unit as set forth in claim 3 characterized in that at least two said motion members are arranged on the axis.

18. The modular article dispenser of claim 8 wherein the rotary body has a substantially cylindrical shape with a lobe provided between adjacent recesses, each said lobe having a free end wgich forms a part of a cylindrical peripheral contour of the rotary body.

* * * * *